US008181584B2

(12) United States Patent
Bilirgen et al.

(10) Patent No.: US 8,181,584 B2
(45) Date of Patent: May 22, 2012

(54) ON-LINE COAL FLOW CONTROL MECHANISM FOR VERTICAL SPINDLE MILLS

(76) Inventors: Harun Bilirgen, Bethlehem, PA (US); Edward Kenneth Levy, Bethlehem, PA (US)

( * ) Notice: Subject to any disclaimer, the term of this patent is extended or adjusted under 35 U.S.C. 154(b) by 547 days.

(21) Appl. No.: 12/456,854

(22) Filed: Jun. 23, 2009

(65) Prior Publication Data

US 2010/0000450 A1 Jan. 7, 2010

Related U.S. Application Data

(63) Continuation-in-part of application No. 11/385,016, filed on Mar. 20, 2006, now Pat. No. 7,549,382, which is a continuation-in-part of application No. 10/936,401, filed on Sep. 8, 2004, now Pat. No. 7,013,815, which is a continuation-in-part of application No. 10/258,630, filed as application No. PCT/US01/12842 on Apr. 20, 2001, now Pat. No. 6,789,488.

(60) Provisional application No. 60/199,300, filed on Apr. 24, 2000, provisional application No. 60/265,206, filed on Feb. 1, 2001.

(51) Int. Cl.

| | |
|---|---|
| ***F23K 3/02*** | (2006.01) |
| ***F23L 13/02*** | (2006.01) |
| ***B02C 23/10*** | (2006.01) |

(52) U.S. Cl. ..... 110/310; 110/106; 241/79

(58) Field of Classification Search ..... 110/232, 110/263, 104 R, 106, 101 R, 309, 310; 241/52, 241/57, 80, 109, 119, 47, 48, 19, 79, 39; 461/155, 156, 157, 159, 160, 161, 162

See application file for complete search history.

*Primary Examiner* — Kenneth Rinehart
*Assistant Examiner* — David J Laux
(74) *Attorney, Agent, or Firm* — Ober, Kaler, Grimes & Shriver; Royal W. Craig

(57) ABSTRACT

An improved apparatus for on-line coal flow control in vertical spindle mills comprising a plurality of independently adjustable flow control elements and positioning rods that adjust the positioning of those flow control elements. Each flow control element is positioned within the discharge turret of the vertical spindle mill along the outer wall of the discharge turret proximate the entrance to its corresponding coal outlet pipe. The adjustable rods are seated on the side or top of the discharge turret of the coal pulverizer and are connected to the flow control element horizontally or vertically as the case may be. The flow control elements can be independently rotated by +/−90 degrees about the positioning rod axis, moved back and forth in the horizontal plane, and can also be moved up and down in the vertical plane. Therefore, each flow control element has three degrees-of-freedom: one rotational and two linear displacements. The apparatus improves boiler performance by making it possible to operate the boiler with reduced pollutant levels (e.g. NOx, CO) and increased combustion efficiency. Automated computer control of the control surfaces is contemplated.

20 Claims, 9 Drawing Sheets

ON-LINE COAL FLOW CONTROL MECHANISM FOR VERTICAL SPINDLE MILLS

CROSS-REFERENCE TO RELATED APPLICATIONS

The present application is a continuation-in-part of U.S. patent application Ser. No. 11,385,016 filed Mar. 20, 2006 now U.S. Pat. No. 7,549,382, which was a continuation in part of U.S. patent application Ser. No. 10/936,401 filed Sep. 8, 2004 now U.S. Pat. No. 7,013,815, which was a continuation-in-part of U.S. patent application Ser. No. 10/258,630 (now U.S. Pat. No. 6,789,488), filed Oct. 24, 2002, which is from International PCT Application PCT/US01/12842 filed Apr. 20, 2001, corresponding to U.S. Patent Application Ser. No. 60/199,300, filed 24 Apr. 2000 and Ser. No. 60/265,206, filed: 1 Feb. 2001, which are each incorporated herein by reference.

BACKGROUND OF THE INVENTION

1. Field of the Invention

The present invention relates to pulverized coal boilers and, more particularly, to a mechanism for directing coal flow to the corresponding outlet pipes of the vertical spindle mill with negligible effect on the pre-existing primary air flow distribution, the mechanism comprising an array of individually adjustable flow control elements positioned inside the discharge turret of the vertical spindle mill.

2. Description of the Background

Coal fired boilers utilize pulverizers to grind coal to a desired fineness so that it may be used as fuel for burners. In a typical large pulverized coal boiler, coal particulate and primary air flow from the pulverizers to the burners through a network of fuel lines that are referred to as coal pipes. Typically, raw coal is fed through a central coal inlet at the top of the pulverizer and falls by gravity to the grinding area at the base of the mill. Once ground (different types of pulverizers use different grinding methods), the pulverized coal is transported upwards, using air as the transport medium. The pulverized coal passes through classifier vanes within the pulverizer. These classifier vanes may vary in structure, but are intended to establish a swirling flow within the rejects cone to prevent coarse coal particles from flowing into the discharge turret of the pulverizer. The centrifugal force field set up in the rejects cone forces the coarse coal particles to drop back down onto the grinding surface until the desired fineness is met. Once the coal is ground finely enough, it is discharged and distributed among multiple pulverized coal outlet pipes and into respective fuel conduits where it is carried to the burners. Each coal pulverizer is an independent system and delivers fuel (pulverized coal) to a group of burners.

In a conventional coal pulverizer 100 as shown in FIG. 1 (A & B), raw coal 101 is dropped into coal inlet port 102 and by force of gravity falls through coal chute 103 until it reaches the grinding mechanism 104. The grinding mechanism 104 grinds the coal into fine pieces. Air 105 flows into air inlet port 106 through a nozzle ring on the outside perimeter of the grinding mechanism 104, feeding primary air into the pulverizer. This creates a stream of low-velocity air that carries the particles of pulverized coal upward where they enter classifier vanes 109 that establish a swirling flow within a reject cone 120. The centrifugal force field set up in the reject cone 120 prevents coarse pieces of coal 110 from entering the discharge turret 108. The coarse pieces of coal 110 fall by force of gravity back into the grinding mechanism 104. Once the pulverized coal 107 enters the discharge turret 108 it is distributed between the multiple equal diameter pulverized coal outlet pipes 111 (FIG. 1 shows six pulverized coal outlet pipes 111 at the top). The pulverized coal 107 is then carried by connected fuel conduits to a boiler where it is burned as fuel.

FIG. 2 is a simplified cross-section of the vertical spindle pulverizer as in FIGS. 1A & 1B with four outlet pipes, and FIG. 3 is a top view of FIG. 2. Poor balance of pulverized coal 107 distribution between pulverized coal outlet pipes 111 is commonly experienced in utility boilers. This can be due to various reasons, such as system resistance of each individual fuel conduit, physical differences inside the pulverizer, and coal fineness. The unbalanced distribution of coal among the pulverized coal outlet pipes adversely affects the unit performance and leads to decreased combustion efficiency, increased unburned carbon in fly ash, increased potential for fuel line plugging and burner damage, increased potential for furnace slagging, and non-uniform heat release within the combustion chamber. In addition, it is critical for low NOx (Nitric Oxides) firing systems to precisely control air-to-fuel ratios in the burner zones to achieve minimum production of NOx. The relative distribution of coal between the pulverized coal outlet pipes is monitored by either measuring the pulverized coal flow at the individual pulverized coal outlet pipes or measuring the particular flame characteristics of burning fuel discharged from the each of the burners.

The distribution of primary air throughout the coal piping network is controlled by the flow resistances of the various coal pipes. Because of differences in pipe lengths and numbers and types of elbows in each fuel line, the different coal pipes from a pulverizer will usually have different flow resistances. It is known that fixed or adjustable vanes may be used to directly divert the coal flow distribution among the outlet pipes 111. The following references describe the use of vanes to modify coal flow distribution.

U.S. Pat. No. 4,570,549 to N. Trozzi shows a Splitter for Use with a Coal-Fired Furnace Utilizing a Low Load Burner.

U.S. Pat. No. 4,478,157 to R. Musto shows a Mill Recirculation System.

U.S. Pat. No. 4,412,496 to N. Trozzi shows a Combustion System and Method for a Coal-Fired Furnace Utilizing a Low Load Coal Burner.

Finally, U.S. Pat. No. 2,975,001 issued on Mar. 14, 1961 to Davis discloses an apparatus for dividing a main stream of pulverized coal between two branch streams. (Col. 1, lines 50-52). The apparatus may be used alone or in conjunction with a conventional slotted riffle. (Col. 1, lines 70-73). The apparatus is comprised of a combination fixed and tiltable nozzle. (Col. 1, lines 50-58). The fixed nozzle is attached to the main duct leaving the pulverizer and concentrates the coal and air flow (see claims 1-5). The concentrated coal and air flow is then directed into the tiltable nozzle with the highest concentration of coal necessarily being at the nozzle centerline. The tiltable nozzle is then "tilted" in order to direct the concentrated coal and air flow into one or the other branch stream. Guide vanes may be mounted inside the tiltable nozzle; however, this patent does not disclose adjustable guide vanes. (Col. 1, lines 58-60).

All of the foregoing references teach a form of direct diversion of the coal flow, but this likewise causes direct diversion of the air flow. It is impossible using direct diversion to increase or decrease the flow of coal into a particular outlet pipe without effecting primary air flow, or vice versa.

In contrast to an adjustable baffle approach which makes it difficult to simultaneously balance coal and primary air flow rates, the present invention makes it possible to increase or decrease the coal flow in any one of the above-described outlet pipes 111 without affecting the pre-existing air flow distribution among the outlet pipes by changing the position and/or orientation of the control vane in the region of high particle concentration. This unique approach makes it possible to balance the coal flow distribution among the outlet pipes, while eliminating the need to readjust the air flow distribution among the outlet pipes after achieving the desired coal flow rate distribution.

SUMMARY OF THE INVENTION

It is, therefore, a main object of the present invention to provide an improved apparatus for on-line coal flow control in vertical spindle mills and, specifically, for the on-line balancing and control of pulverized coal flow into the multiple pulverized coal outlet pipes of pressurized vertical spindle mills.

It is another object to eliminate coal flow imbalances at crucial points in a pulverized coal boiler system using an on-line adjustment capability that does not disturb any pre-existing primary air flow balance among the multiple coal pipes, thereby reducing pollutant emissions and improving combustion efficiency.

It is another object to simplify the coal flow balancing process and eliminate the need of adjustments to the primary air flows between the outlet pipes after achieving the desired coal flow rates between the coal pipes.

It is still another object to maintain a balanced coal flow distribution among the pulverized coal outlet pipes despite mill load changes, eliminating or automating the need for re-adjusting the flow control element positions as the mill coal loading changes.

It is still another object to provide an improved apparatus for on-line coal flow control in vertical spindle mills that can readily be installed within an existing pressurized vertical spindle pulverizer (within the discharge turret).

It is still another object to provide an improved apparatus for on-line coal flow control in vertical spindle mills that contributes no significant pressure drop to the flow system.

In accordance with the present invention, an improved apparatus for on-line coal flow control in vertical spindle mills is described which comprises a plurality of independently adjustable flow control elements and a means for adjusting the positioning and/or orientation of those flow control elements. Each flow control element is positioned within the discharge turret of the pulverizer at some appropriate vertical distance from the entrance to the coal outlet pipes. Each flow control element includes an independently adjustable rod seated on the side of the discharge turret of the coal pulverizer and connected to the flow control element horizontally or, alternately, seated on the top of the discharge turret and connected to the flow control element vertically. The flow control elements can be independently rotated by +/−90 degrees about the a horizontal radial axis with respect to the turret, and can also be moved back and forth in the horizontal plane as well as up and down in the vertical plane. Therefore, each flow control element has three degrees-of-freedom: one rotational and two linear displacements. A combination of rotational and linear movements is used to control the coal flows in each pulverized coal outlet pipe, and the flow control elements have neutral positions at which the pre-existing coal and primary air flow distributions between the pulverized coal outlet pipes are undisturbed.

The foregoing apparatus provides on-line balancing and control of pulverized coal flows into the multiple pulverized coal outlet pipes of a pulverizer, thereby improving boiler performance by making it possible to operate the boiler with reduced pollutant levels (e.g. NOx, CO) and increased combustion efficiency.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENT

Figure 1:
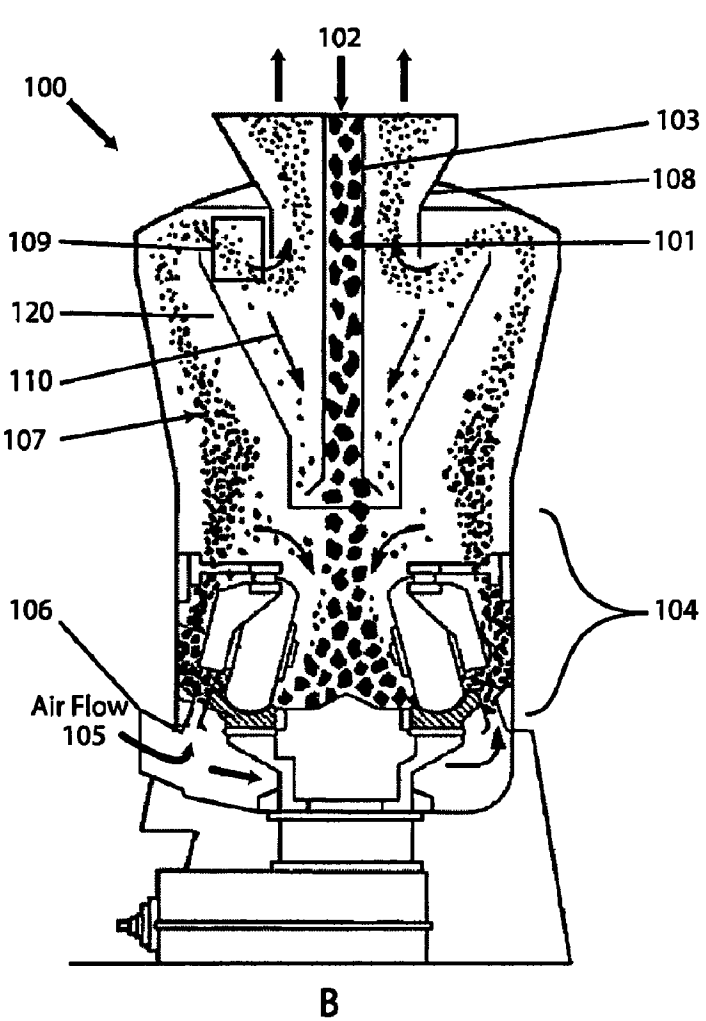
FIG. 1 (PRIOR ART)
FIG. 1 is a prior art vertical spindle mill, FIG. 1A showing a cut-away view and FIG. 1B a cross-section.
Figure 1:
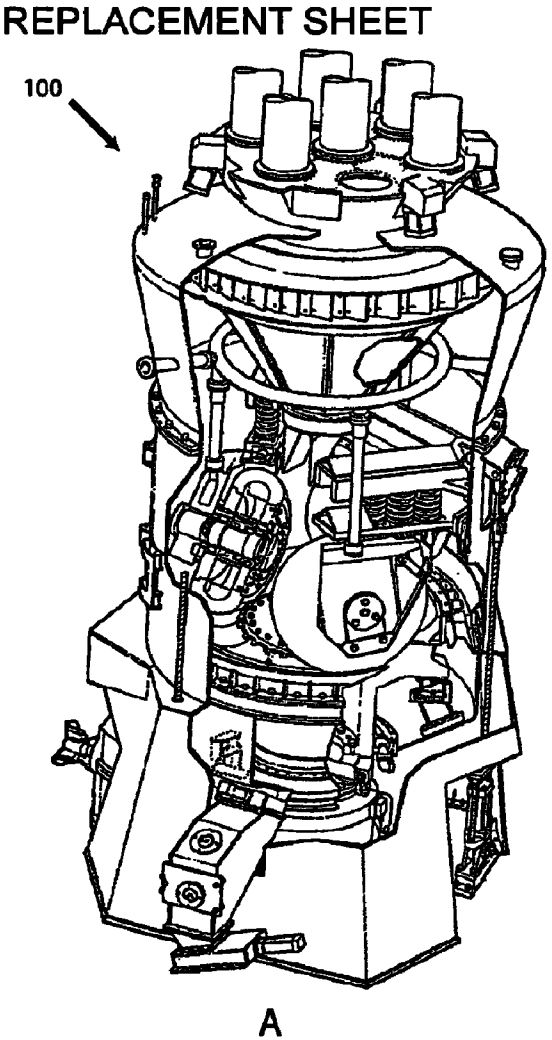
FIG. 1 (PRIOR ART)
Figure 3:
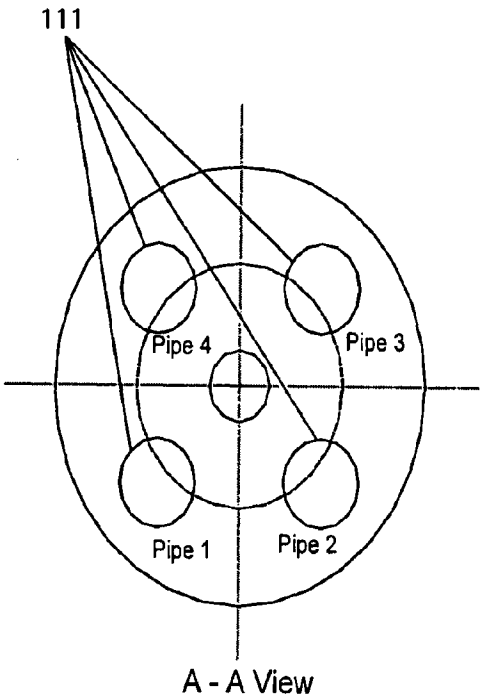
FIG. 3 (PRIOR ART)
FIG. 3 is a top view of the prior art vertical spindle mill as in FIGS. 1-2.
Figure 2:
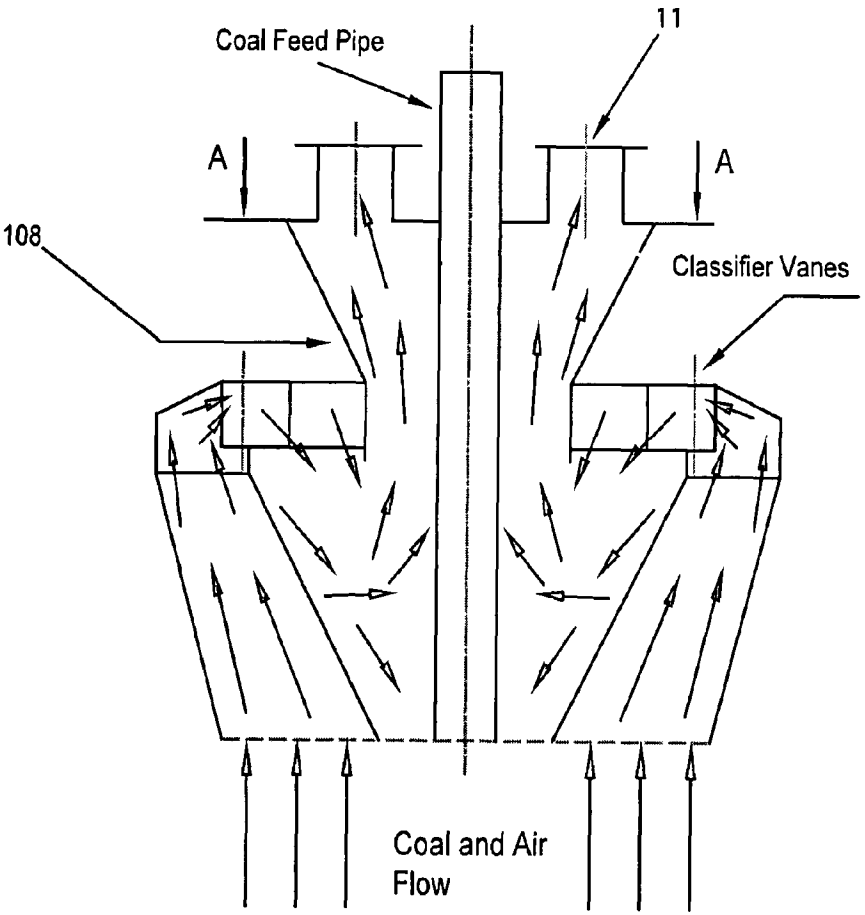
FIG. 2 (PRIOR ART)
FIG. 2 is a simplified cross-section of the prior art vertical spindle mill as in FIGS. 1A & 1B.

It is imperative for good combustion that any flow control mechanism incorporated in a vertical spindle mill as described above have little or no effect on the distribution of primary air. However, most coal boilers use baffles or orifice-type flow restrictors in individual pipes which have precisely this direct effect. Specifically (and referring back to FIG. 2), the air and coal particle flow structures within the discharge turret 108 determine the coal and air flow distributions between the pulverized coal outlet pipes 111. The present inventors have undertaken computational fluid dynamics (CFD) simulations to understand the coal and air flow structures within the discharge turret 108 of such a vertical spindle mill.

Figure 4:
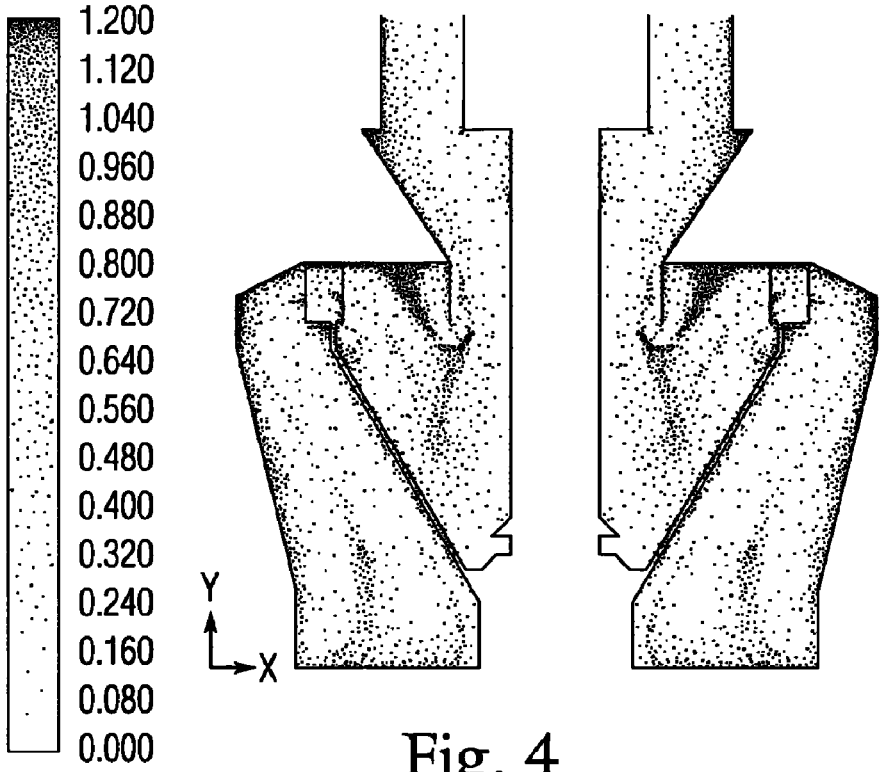
FIG. 4 depicts computational fluid dynamics (CFD) simulation results for the particulate concentration distribution in a vertical spindle mill with contour legend shown at left.

FIG. 4 depicts CFD results for the coal flow concentration distribution within the vertical spindle mill with particle concentration mapped and indexed at left. The CFD simulation results showed a complex, 3-dimensional flow with very high radial and tangential velocity components of the air and particle flows within the discharge turret 108. The coal and air mixture makes several turns before it reaches the inlet of the outlet pipes 111. The flow mixture first makes a U-turn in the z-axis plane as it gains tangential velocity while going through classifier vanes 109 in the horizontal plane. Immediately before the discharge turret 108 inlet, the mixture makes another U-turn in the z-axis plane just before it enters the discharge turret 108. Immediately after particles enter the funnel-shaped discharge turret 108, they are forced toward the outer wall by the tangential and radial velocity components of the air flow. In a very short axial distance in the discharge turret 108 the majority of the particles accumulate in the vicinity of the discharge turret 108 outer wall. The drag force in the radial direction due to the flow expansion and the centrifugal force created by the tangential velocity within the discharge turret 108 are the major parameters that determine the particle trajectories and consequently the particle flow distribution between the outlet pipes.

Figure 5:
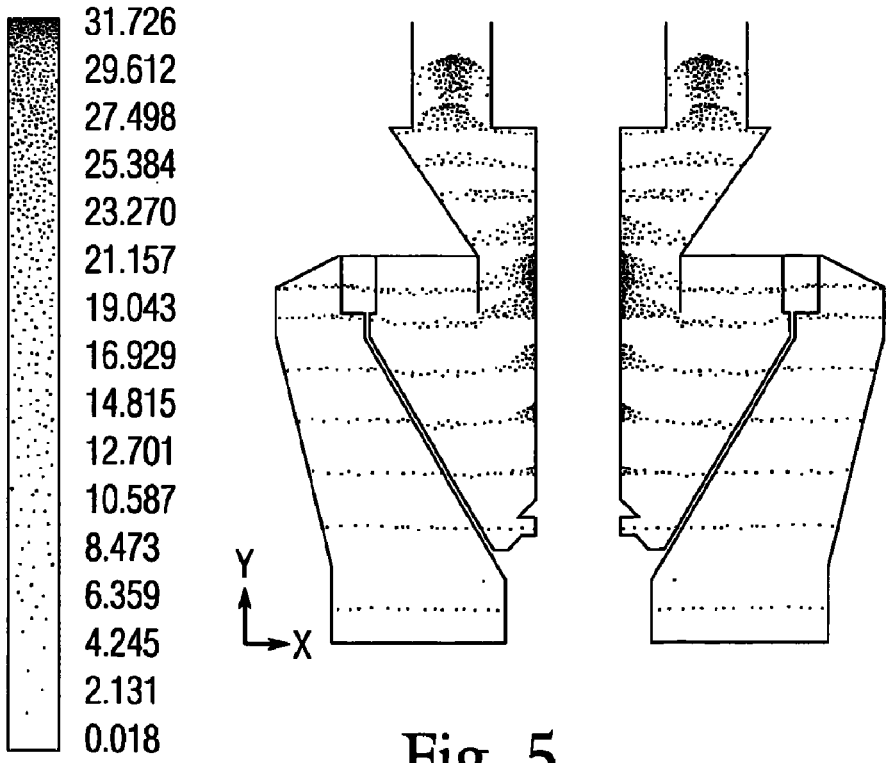
FIG. 5 depicts CFD simulation results for the velocity vector field of the air flow with velocity vector legend shown at left.

FIG. 5 depicts CFD results for the velocity vector field of the air flow. Similar to the coal flow, stratification in air flow is also observed as the air flow makes U-turns. A gradually decreasing air velocity profile from the inner to the outer wall of the discharge turret 108 is established at the inlet plane of the discharge turret 108. Phase segregation within the discharge turret 108 is initiated at the entrance of the discharge turret 108 and propagates as the mixture advances in the axial direction.

The flow in the pulverized coal outlet pipes 111 is categorized as dilute phase pneumatic conveyance in which air and micron size particles flow together. The density of the coal particles is almost 1,400 times higher than that of the air. The particulate and air flows show significant differences when they flow together in a pipe due to this enormous density difference. The air flow can quickly respond to the geometrical changes in the pipe layout while it takes longer times for particles.

The present invention relies on the fact that a phase separation between air and coal flows occurs within the discharge turret as shown in the CFD simulation results (FIGS. 4, 5). Highly concentrated particle flow and high primary air velocity regions are established in the outer and inner walls of the discharge turret 108, respectively. This separation in the flow is due to the drag force in the radial direction caused by the flow expansion and the centrifugal force created by the tangential velocity within the discharge turret 108, which is a generally funnel-shaped conduit. In accordance with the present invention, individually-adjustable flow control elements are positioned in the region where highly concentrated particle flow exists proximate the discharge turret 108 outer wall. This allows control of the coal flow distribution (FIG. 4) without affecting the distribution of primary air (FIG. 5).

Figure 6A:
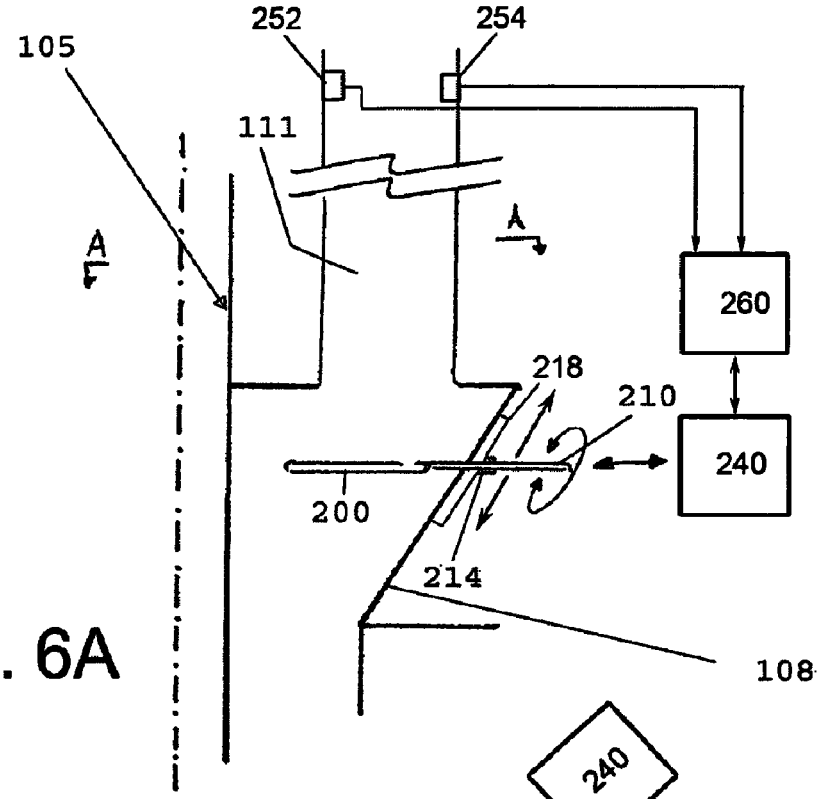
FIG. 6 is a side section view (at A) and top view (B) illustrating an array of individually adjustable flow control elements 200 (one being shown at A) positioned inside the funnel-shaped discharge turret 108 of a vertical spindle mill.
Figure 6B:
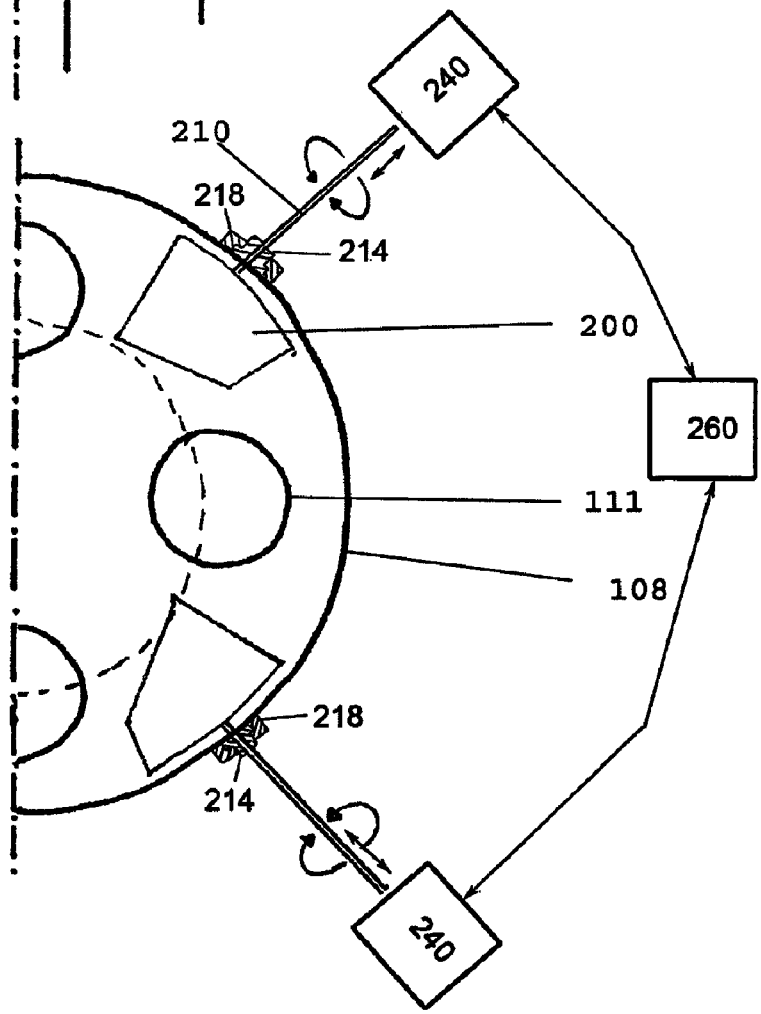

FIG. 6 is a side section view (at A) and top view (B) illustrating one embodiment of the present invention comprising an array of individually adjustable flow control elements 200 (one exemplary one being shown at A) positioned inside the funnel-shaped discharge turret 108 of a vertical spindle mill. It should be noted that while the depicted embodiment implies a one to one relationship between flow control elements 200 and coal outlet pipes 111, no such correlation is required and optimized coal flow balance may be achieved with a greater or lesser number of flow control elements as compared to outlet pipes. As will be described, the geometry, position and orientation of the flow control elements 200 are optimized in such a way that the coal flow rate adjustments between the outlet pipes 111 has negligible effect on the pre-existing primary air flow distribution in the pulverized coal outlet pipes 111.

Each individual flow control element 200 is adjustably mounted for independent linear positioning up and down along the walls of the discharge turret 108, radially in and out from the walls of the discharge turret 108, and rotationally. In the illustrated embodiment this is accomplished by mounting each individual flow control element 200 on an articulated positioning rod 210 which is pivotally and slidably retained in a rod seat 214 inside the wall of the discharge turret 108. The rods 210 pass through an aperture in the wall of the turret and are rigidly affixed to the corresponding flow control element 200. Each independently adjustable positioning rod 210 is retained in a substantially horizontal position in the rod seat 214 which may be one or more sealed bushings or bearings. The rod seat permits the rod to slide horizontally in and out of the turret wall in a radial direction relative to the vertical axis of the turret in order to permit radial adjustment of the flow control element 200 position. Once adjusted to the desired horizontal (radial) position the rod may be locked in place. The rod seat 214 further permits rotation of the positioning rod 210 about its primary axis by +/−90 degrees thereby adjusting the orientation of the rigidly attached flow control element within the coal flow stream of the turret. Once rotationally adjusted to the desired orientation the rod may also be locked in place. Locking of the rod 210 horizontal (radial) position is independent of rotational movement/locking of the rod 210.

Rod Seat 214 is further slidably retained to the wall of the turret so as to be slidable in a vertical (up and down) plane. Sliding of the rod seat 214 is independent of and does not affect the rotational orientation of the positioning rod 210 within the seat, but may affect the radial position of the flow control element 200 within the wall of the turret inasmuch as the walls of the turret 108 may be inclined (funnel shaped) as shown. Sliding of the rod seat 214 in a vertical (up and down) plane may be accomplished as shown by journaling the rod seat 214 bushing or bearing into a linear motion guide track 218 for slidable translation there along, the track 218 is in turn being mounted along an outside surface of the outer wall of the turret 108. Lateral translation of the rod seat 214 vertically in the track 218 necessarily translates the attached positioning rod 210 and flow control element 200 in the vertical thereby adjusting its position upstream relative to the inlets of the outlet pipes. Once positioned vertically as desired the rod seat 214 is preferably locked in position, and this locking of the rod seat 214 position is independent of movement/locking of the rod 210 in any other degree of freedom.

The aperture through which the positioning rod enters the turret wall 108 may be appropriately elongated in a slot configuration to accommodate vertical movement due to sliding of the rod seat 214. An overlapping gasket or other suitable means of sealing portions of the slot not occupied by the position rod 210 may be used to prevent pressure loss in the turret or dust expulsion at the aperture. In an alternate embodiment (not pictured) the aperture may be eliminated by mounting the track 218, rod seat 214 and rod 200 strictly on an inside surface of the outer wall of the turret 108. However, inside mounting of the rod seat 214 sacrifices the independent radial and vertical translation of the flow control element 200 in favor of correlated lateral and vertical translation of the flow control element 200 as the rod seat 214 is moved up or down the sloped outer wall of the turret 108.

Movement of the rod seat 214 and/or positioning rod 210 is accomplished by a positioning actuator 240 which may be any suitable positioning actuator providing precision 2-axis translation and 1-axis rotation adjustment for independent linear positioning of the rod 210 and rod seat 214 up and down along the walls of the discharge turret 108, radially in and out from the walls of the discharge turret 108, and rotationally. Positioning actuator 240 may be a combination of a track positioner for positioning of the rod 210 and rod seat 214 up and down along the track 218, a linear actuator for pushing/pulling the rod 210 radially in and out from the walls of the discharge turret 108, and a rotary actuator for rotating the rod 210. Positioning actuator 240 may include one or a combination of hydraulic actuators, hydraulic motors, electric motors, or manual adjustment knobs, or other means capable of opposing the forces applied to the flow control elements by the coal, and to a lesser extent the air, moving through the turret.

Coal mass flow sensors 252 and air flow sensors 254 may be placed within individual coal pipes to monitor coal distribution and air flow, respectively, and to automatically and individually adjust the positions of the flow control elements 200 to maintain the desired distribution between the various outlet pipes 111. In this case the positioning actuators 240 slave to a control device 260 which implements automatic control and positioning logic. The control device 260 may be tied to, or part of, the vertical spindle mill central control system. This control device 260 may comprise a suitable programmable logic controller (PLC), a distributed control system (DCS), a central computer, a series of interconnected discrete control components, or any combination thereof.

One skilled in the art should recognize that downstream conditions may further comprise or incorporate monitoring of burner and/or exhaust gas performance and conditions (such as temperature, NOx emissions, CO emissions, and exhaust particulate content) in order to optimize coal distribution to the burners. Monitoring of downstream conditions by any of a variety of sensors and corresponding automatic adjustment of the coal flow control elements 200 may be accomplished using control device 260. The control device 260 receives sensor monitoring information as input from the downstream sensors 252, 254 or others, and determines the optimum position of the flow control elements 200 in real time. The control device 260 then actuates the positioning actuator 240 to move the flow control elements 200 into the position necessary to achieve the determined optimum conditions.

As illustrated, the presently-preferred shape of the flow control elements 200 is a substantially flat plate having an oblique trapezoidal shape, the oblique angle conforming to the slope of the discharge turret outer wall 108. The upper-outer edge of each flow control element 200 is truncated (such as rounded) to allow at least +/−90 degree rotation without obstruction when fully retracted against the discharge turret 108 outer wall. The flow control element 200 position is considered to be 0 degrees when it is positioned vertically (inline parallel to the outlet pipes 111).

FIG. 6 illustrates the flow control elements 200 in their +/−90 degree position (substantially horizontal).

Figure 7A:
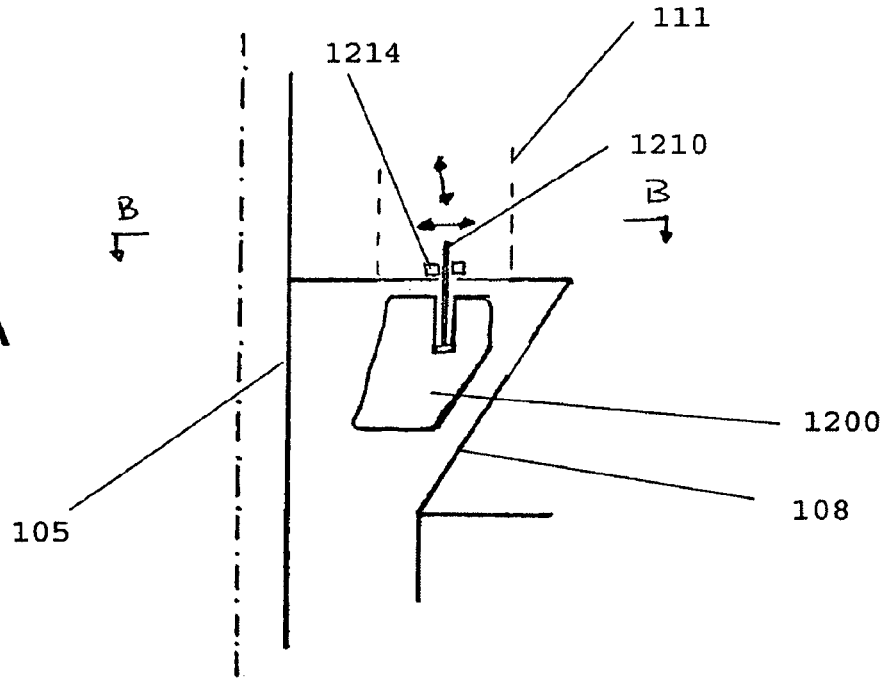
FIG. 7 is a side section view (at A), top view (at B) and orthogonal side section view illustrating flow control element 200 utilizing a turret top mounting seat.
Figure 7B:
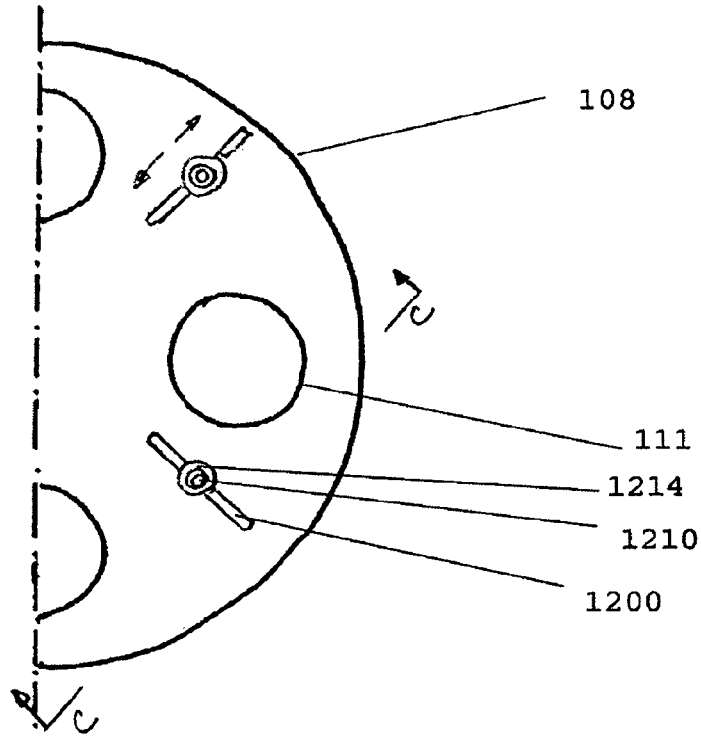
Figure 7C:
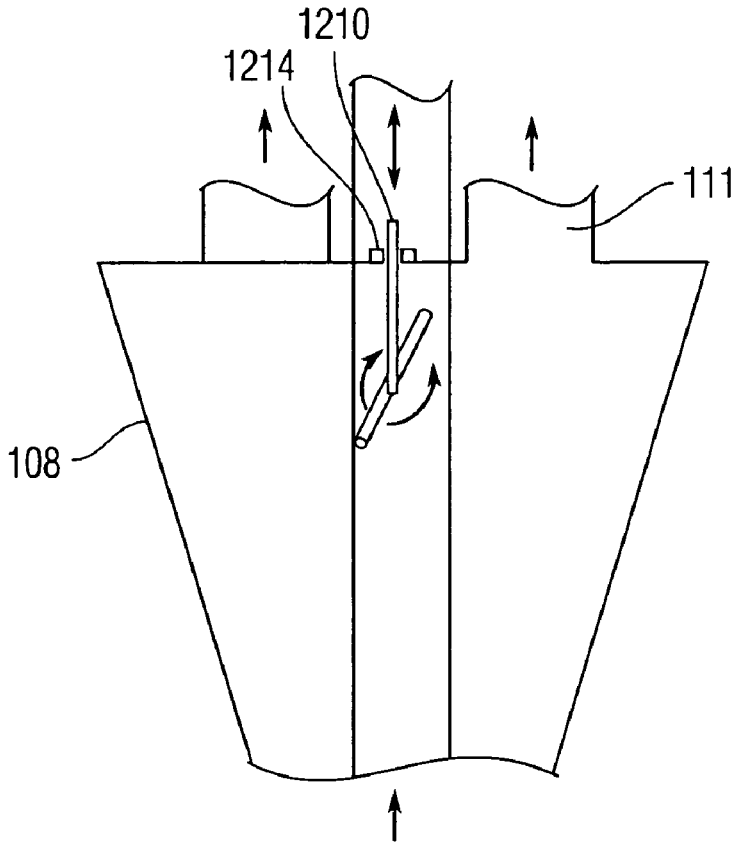

With reference to FIGS. 7A, 7B and 7C, an alternate embodiment of the present invention is disclosed in which the rod seat 1214 is position at the top of the turret (best seen in FIG. 7A or 7C. As above, positioning rod 1210 is slidably retained in the rod seat and affixed to the flow control element 1200 via an aperture in the turret wall (top). Sliding of the positioning rod 1200 into/out of the seat adjusts the vertical positioning of the flow control element within the turret and thereby adjusts the upstream position of the flow control element with respect to the outlet pipe 111. The rod seat 1210 is further slidably affixed to the top of the turret so as to be slidable radially in the horizontal plane thereby adjusting the horizontal position of the flow control element 1200 radially within the turret and with respect to the outlet pipe 111.

Figure 8:
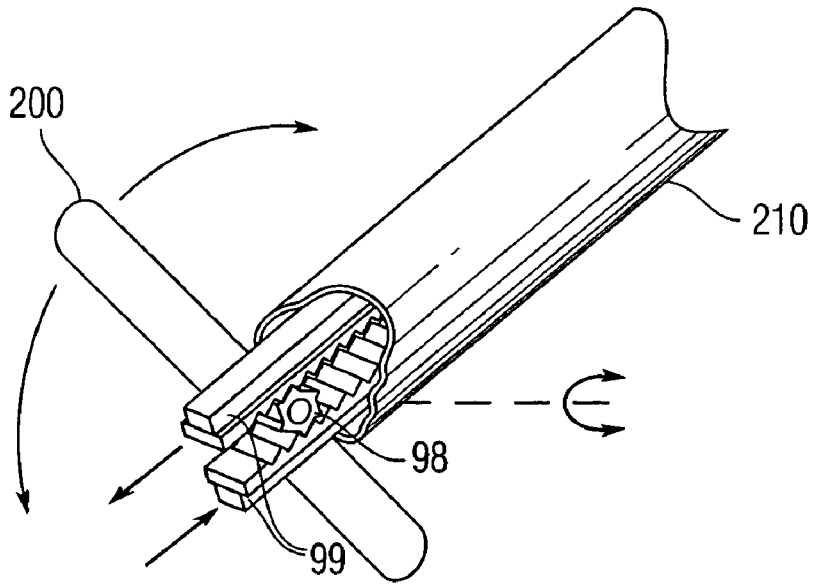
FIG. 8 is a partial cutaway perspective of view of a positioning rod having an internal pinion gear for controlling vane orientation.

Rotation of the flow control element 1200 with respect to the horizontal radial axis of the turret may be accomplished by an electronically controlled stepper motor or hydraulic motor within the flow control element 1200. In an alternate embodiment, opposing parallel thrust arms 99 may be inserted into the positioning rod 1210 which is hollow in this embodiment, as depicted in FIG. 8. The thrust arms are provided with opposing racks of teeth with a captured pinion gear 98 between them. Hydraulic actuators at the rod seat drive the thrust arms 99 in opposing directions thereby rotating the pinion 98 which is affixed at its center to the flow control element 1200 causing it to rotate and assume the desired position.

The preferred shape, size, and geometrical details of the flow control elements 200 (and 1200) as well as the preferred distance from the entrance to the pulverized coal outlet pipes 111 to the flow control elements 200 were quantitatively determined by laboratory tests using a laboratory scale vertical spindle mill type pulverizer having four outlet pipes 111 and configured with four flow control elements 200. During the experiments both the distribution of pulverized coal into the individual pulverized coal outlet pipes and primary air flow were monitored. The results indicated that the positioning the flow control elements 200 within the discharge turret 108 upstream of the entrance to the pulverized coal outlet pipes 111 provides the most efficient method for controlling the distribution of pulverized coal flows among the outlet pipes while having a negligible effect on air flow distribution.

Figure 10:
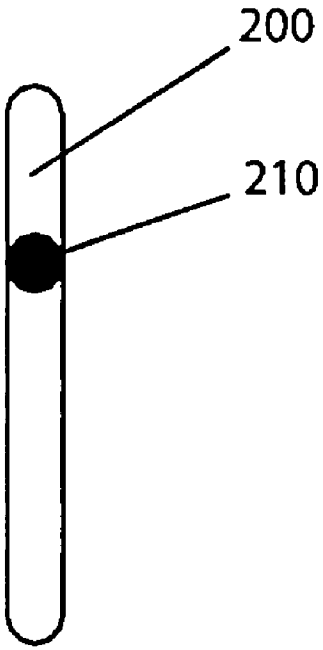
FIG. 10 is a front view of the flow control element 200 with adjustment rod 210 as in FIG. 9.
Figure 9:
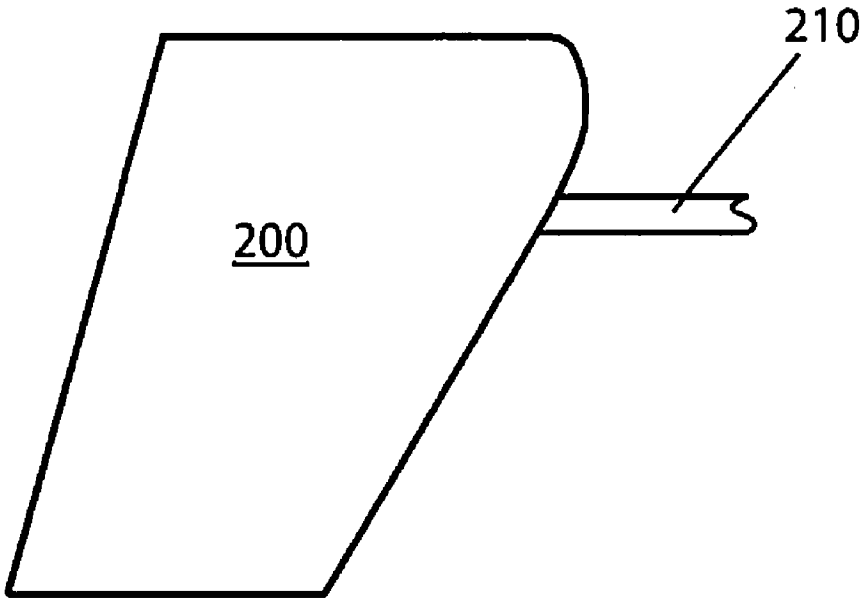
FIG. 9 is a side view illustrating the shape and relative dimensions the presently-preferred flow control element 200 with adjustment rod 210.

FIG. 9 is a side view illustrating the shape and relative dimensions the presently-preferred flow control element 200 with adjustment rod 210, and FIG. 10 is a front view. As stated above, the presently-preferred flow-control element 200 is an oblique trapezoid. The top-right corner of the flow control element is rounded to make the flow control element fit inside the discharge turret 108. Of course, other flow control element 200 shapes are possible such as contoured instead of flat plate and with shapes other than trapezoidal, including triangular, rectangular, squared and ellipsoid shapes. The flow control elements 200 are positioned in the region where highly concentrated particle flow exists at the discharge turret 108 outer wall.

In all cases the shape, size, and distance of the flow control elements from the outlet pipes (both laterally and upstream) may be predetermined by testing and cataloging the results for a particular pulverizer in light of the different dimensions and internal configuration of the particular pulverizer. Test results confirm the effectiveness of the present invention in controlling the coal flow distribution, without affecting the pre-existing air flow distribution.

Figure 11:
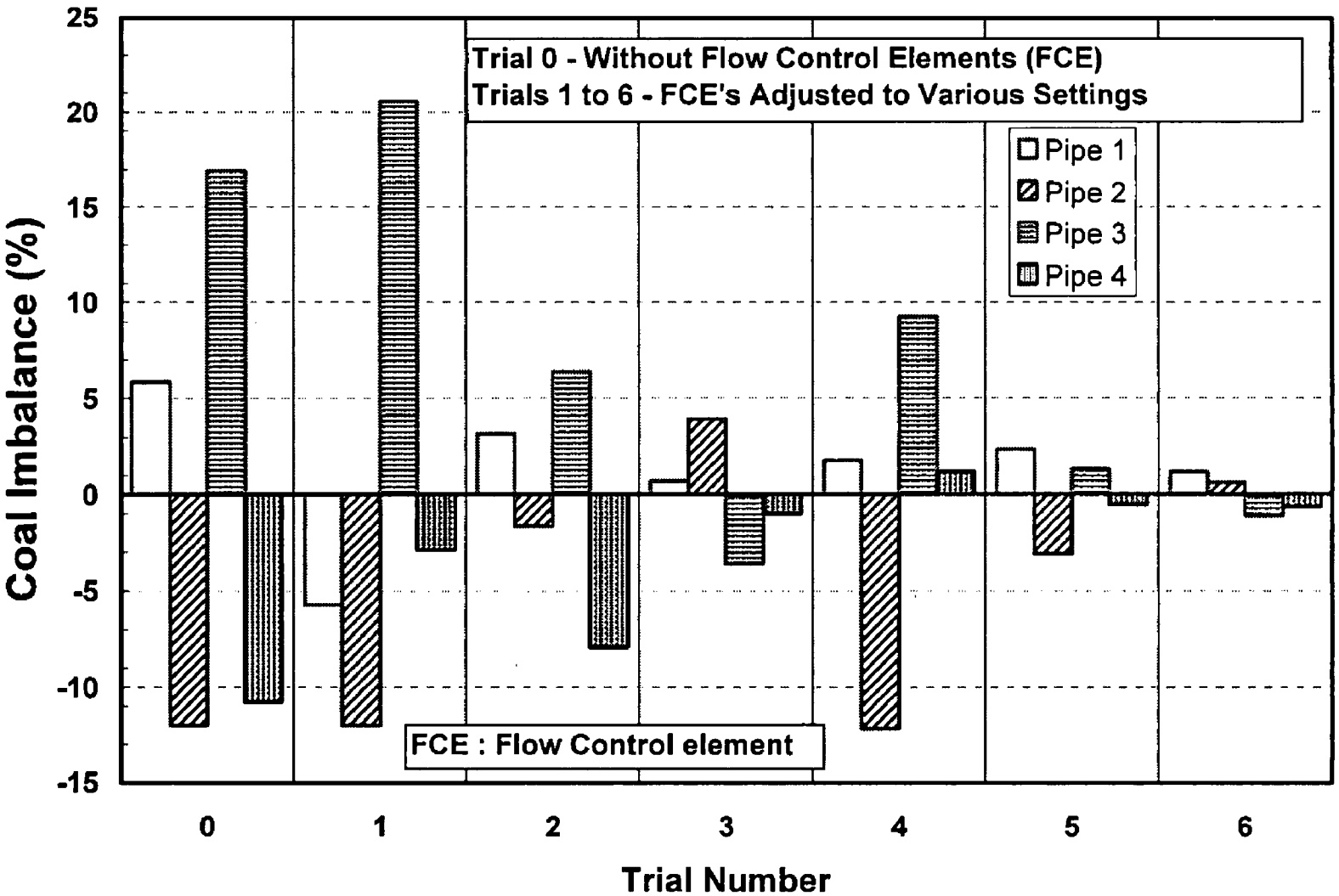
FIG. 11 illustrates the percentage of pulverized coal flow imbalance between the outlet pipes with and without the flow control elements 200.

FIG. 11 illustrates the percentage of pulverized coal flow imbalance between the outlet pipes with and without the flow control elements. A number of trials were completed to balance the coal flows between the pulverized coal outlet pipes by adjusting the flow control elements 200 individually.

Figure 12:
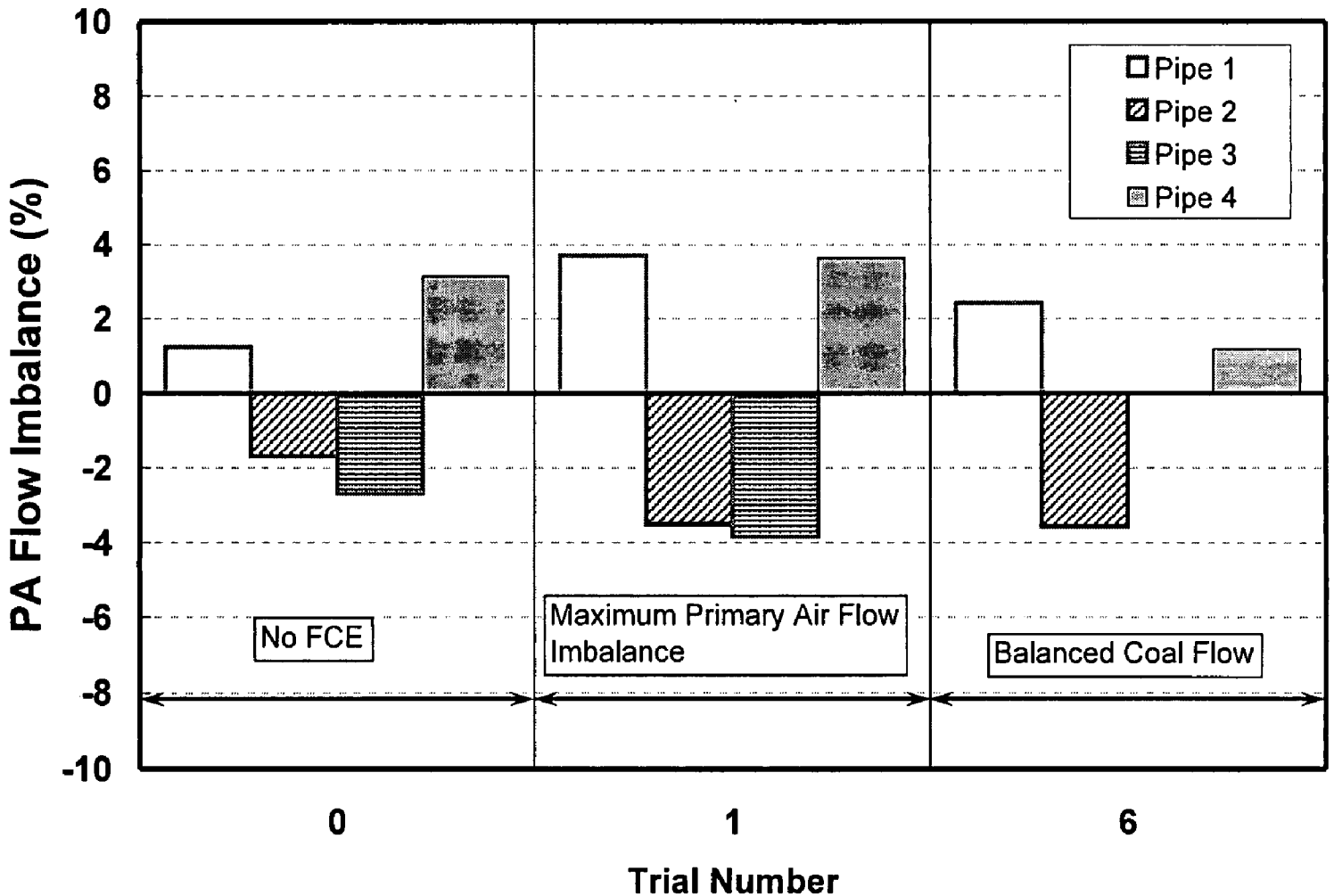
FIG. 12 is a comparative graph showing the effect on primary air flow distribution both with and without the flow control elements 200.

FIG. 12 is a comparative graph of the results of the laboratory experiments showing the effect on primary air flow distribution when the pulverizer was configured both with and without the flow control elements 200. During the coal flow balancing process, the maximum primary air flow imbalance was within +/−4.0 percent (trial #1). For the case where there was no flow control element installed, the imbalance in the primary air flow between the pulverized coal outlet pipes was less than +/−3.0 percent (trial #0). There was no measurable effect of coal flow balancing on the primary air flow distributions between the coal outlet pipes 111 (trial #6).

With combined reference to FIGS. 11 and 12, more than twenty percent change in coal flow rate was achieved with the flow control elements 200 (FIG. 11) while the maximum change in the primary air flow was less than 5 percent (FIG. 12).

Laboratory experiments were also performed to investigate the effect of coal flow loading on the effectiveness of the present invention. The experiments were performed for a coal flow loading range of +/−30 percent at a constant primary air flow rate. Coal flow loading variations within +/−30 percent were found to have a negligible effect on the existing coal and primary air flow distributions once the coal flow rates between the pulverized coal outlet pipes were balanced. The coal and the primary air flow imbalances between the outlet pipes remained within +/−5.0 percent. This is a very useful feature of the present invention since it eliminates the need for re-adjusting the flow control element positions as the mill coal loading changes. In addition, no noticeable increase in pressure drop due to the flow control elements and their adjustments was measured during the experiments.

It is also noteworthy that in some vertical spindle mills, there are two, three, or more outlet streams. It should be understood that the present invention encompasses system configurations in addition to those described above (for 2 or more outlet pipes 111).

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

We claim:

1. In a vertical coal pulverizer having a discharge turret for expelling pulverized coal particles, said discharge turret having an inner wall and funnel-shaped outer wall with oblique slope and a plurality of pulverized coal outlet pipes leading outward from said discharge turret, a device for balancing and controlling the distribution of pulverized coal particles into the plurality of outlet pipes without substantially affecting the distribution of primary air flow, comprising:

a plurality of adjustable coal-flow-diverting guide-vane elements within a region in said discharge turret of highly concentrated particle flow resulting from a phase separation between air and pulverized coal particle flows, said plurality of coal-flow-diverting guide-vane elements each comprising a plate, said plate positioned within said discharge turret proximate to said outer wall in a region of highly concentrated particle flow resulting from a phase separation between air and pulverized coal particle flows occurring within the discharge turret and rotatable by at least +/−90 degrees from said vertical orientation along an axis running perpendicular to said corresponding outlet pipe; and an adjustment rod affixed to said plate and rotatably and slidably retained in a rod seat in the outer wall of said discharge turret for substantially horizontal linear movement along said axis and rotation about said axis, said rod seat further adapted for substantially vertical lateral sliding along the outer wall of the turret, the position and orientation of said coal-flow-diverting guide-vane elements being thereby each independently adjustable within the flow stream relative to said plurality of outlet pipes to selectively vary the pulverized coal particle flow trajectories without causing a significant pressure drop or affecting primary air flow distribution inside said discharge turret thereby selectively altering a mass flow rate of the pulverized coal flow into each of the outlet pipes.

2. The device for balancing and controlling the distribution of pulverized coal into the plurality of outlet pipes of claim 1, wherein said rod seat is slidably restrained within a track extending linearly along an external surface of said turret.

3. The device for balancing and controlling the distribution of pulverized coal into the plurality of outlet pipes of claim 2, wherein said track is positioned over a linear aperture in said outer wall of the turret through which said adjustment rod passes, said linear aperture being fluidly sealed to prevent pressure drop in said turret.

4. The device for balancing and controlling the distribution of pulverized coal into the plurality of outlet pipes of claim 2, wherein an edge of each flow control element proximate said outer wall of said discharge turret is contoured to conform to the curvature of said outer wall when said flow control element is in the +/−90 degree rotation position.

5. The device for balancing and controlling the distribution of pulverized coal into the plurality of outlet pipes of claim 2, wherein each of said guide-vane elements comprises rounded edges and smooth planar sides.

6. The device for balancing and controlling the distribution of pulverized coal into the plurality of outlet pipes of claim 1, wherein each of said guide-vane elements is mounted on and supported by said corresponding adjustment rod, said corresponding adjustment rod allowing for independent adjustments of the position of each guide-vane element relative to the inlets of the coal pipes at the top of the discharge turret in an upstream/downstream direction and a lateral horizontal direction in order to alter the trajectories of the coal particles in the turret region, thereby balancing coal flow among the outlet pipes.

7. The device for balancing and controlling the distribution of pulverized coal into the plurality of outlet pipes of claim 1, further comprising means for monitoring coal mass flow in each outlet pipe;

means for determining an optimum coal mass flow in each outlet pipe in real time; and means for independently and automatically adjusting the position and orientation of the guide-vane elements relative to the outlet pipes so as to continuously maintain coal mass flow distribution at an optimum level.

8. The device for balancing and controlling the distribution of pulverized coal into the plurality of outlet pipes of claim 7, further comprising means for independently monitoring each coal burner performance.

9. The device for balancing and controlling the distribution of pulverized coal into the plurality of outlet pipes of claim 7, further comprising means for independently monitoring exhaust gas constituents.

10. The device for balancing and controlling distribution of pulverized coal into the plurality of outlet pipes of claim 2, wherein each rod seat further comprises a sealed bushing held captive within said track such that each rod may be rotated or slid back and forth within its bushing to adjust the position of the attached flow control element.

11. In a vertical coal pulverizer having a discharge turret for expelling pulverized coal particles, said discharge turret having an inner wall and funnel-shaped outer wall with oblique slope, and a plurality of pulverized coal outlet pipes leading outward from said discharge turret, a device for balancing and controlling the distribution of pulverized coal particles into the plurality of outlet pipes without substantially affecting the distribution of primary air flow, comprising:

a plurality of adjustable coal-flow-diverting guide-vane elements within a region in said discharge turret of highly concentrated particle flow resulting from a phase separation between air and pulverized coal particle flows, said plurality of coal-flow-diverting guide-vane elements each comprising a plate, said plate positioned within said discharge turret proximate to said outer wall in a region of highly concentrated particle flow resulting from a phase separation between air and pulverized coal particle flows occurring within the discharge turret and rotatable by at least +/−90 degrees from said vertical orientation along an axis of rotation running perpendicular to the coal outlet pipes; and an adjustment rod rotatably affixed to said plate and slidingly retained in a rod seat in the top wall of said discharge turret for substantially vertical linear movement in an up and down direction and rotation of said plate about said axis of rotation, said seat further adapted for substantially horizontal lateral sliding radially with respect to the turret, the position and orientation of said coal-flow-diverting guide-vane elements being thereby each independently adjustable within the flow stream relative to said plurality of coal outlet pipes to selectively vary the pulverized coal particle flow trajectories without causing a significant pressure drop or affecting primary air flow distribution inside said discharge turret thereby selectively altering a mass flow rates of the pulverized coal flows into the various outlet pipes.

12. The device for balancing and controlling the distribution of pulverized coal into the plurality of outlet pipes of claim 11, wherein said rod seat is held captive within a track and is slidably positionable there along on an external surface of said turret.

13. The device for balancing and controlling the distribution of pulverized coal into the plurality of outlet pipes of claim 12, wherein said track extends overtop a corresponding linear aperture in said top wall of the turret through which said adjustment rod passes, said linear aperture being fluidly sealed to prevent pressure drop in said turret.

14. The device for balancing and controlling the distribution of pulverized coal into the plurality of outlet pipes of claim 12, wherein each of said guide-vane elements is mounted on and supported by said corresponding adjustment rod, said corresponding adjustment rod allowing for independent adjustments of the positions of each guide-vane element in an upstream/downstream direction in order to selectively alter the trajectories of the coal particles in the turret region, thereby balancing coal flow among the outlet pipes.

15. The device for balancing and controlling the distribution of pulverized coal into the plurality of outlet pipes of claim 12, wherein said guide-vane elements are rotatably mounted to an end of said adjustment rod and rotatable under the control of a rotary actuator.

16. The device for balancing and controlling the distribution of pulverized coal into the plurality of outlet pipes of claim 12, wherein said guide-vane elements are mounted to a pinion gear captured between a pair of thrust arms within said adjusting rod, said thrust arms having opposing racks of teeth engaging said pinion gear and being hydraulically driven in opposing directions so as to rotate said pinion thereby rotating said flow control element.

17. The device for balancing and controlling the distribution of pulverized coal into the plurality of outlet pipes of claim 11, further comprising:

at least one sensor for monitoring coal mass flow;

a programmable controller in communication with said at least one sensor for determining an optimum coal mass flow in each outlet pipe in real time; and an actuator in communication with said programmable controller for independently and automatically adjusting the position and orientation of the guide-vane elements so as to continuously maintain coal mass flow distribution among the outlet pipes at an optimal level.

18. The device for balancing and controlling the distribution of pulverized coal into the plurality of outlet pipes of claim 17, further comprising means for independently monitoring each coal burner performance.

19. The device for balancing and controlling the distribution of pulverized coal into the plurality of outlet pipes of claim 17, further comprising means for independently monitoring exhaust gas constituents.

20. The device for balancing and controlling distribution of pulverized coal into the plurality of outlet pipes of claim 12, wherein each rod seat is further comprised of a sealed bushing mounted in a car engaged to said track such that each rod may be rotated or slid back and forth within its bushing to adjust the position of the attached guide-vane element independent of said car's position on said track.

* * * * *